US005730647A

United States Patent [19]

Becker et al.

[11] Patent Number: 5,730,647

[45] Date of Patent: Mar. 24, 1998

[54] APPARATUS FOR FINE-GRINDING A CRANKSHAFT

[75] Inventors: Manfred Becker, Novi; Peter Dinardi, Livonia, both of Mich.

[73] Assignee: Ernst Thielenhaus Kg, Wuppertal, Germany

[21] Appl. No.: 810,850

[22] Filed: Mar. 4, 1997

Related U.S. Application Data

[60] Provisional application No. 60/015,629, Apr. 19, 1996.

[51] Int. Cl.[6] ..... B24B 5/00

[52] U.S. Cl. ..... 451/173; 451/49; 451/251

[58] Field of Search ..... 451/51, 49, 251, 451/304, 305, 306, 307, 303, 59, 120, 124, 140, 142, 173, 464, 481, 484, 485, 504, 505, 155

[56] References Cited

U.S. PATENT DOCUMENTS

| | | | |
|---|---|---|---|
| 1,484,353 | 2/1924 | Kidwell | 451/485 |
| 1,560,507 | 11/1925 | Froussard | 451/485 |
| 4,505,071 | 3/1985 | Schwar | 451/173 |
| 4,682,444 | 7/1987 | Judge et al. | 451/303 |
| 4,796,387 | 1/1989 | Johnson | 451/303 |
| 4,945,683 | 8/1990 | Phillips | 451/251 |
| 4,991,361 | 2/1991 | Huppert et al. | 451/464 |
| 5,210,978 | 5/1993 | Phillips | 451/303 |
| 5,311,704 | 5/1994 | Barton II et al. | 451/10 |
| 5,431,592 | 7/1995 | Nakata | 451/303 |
| 5,529,529 | 6/1996 | Judge et al. | 451/464 |

*Primary Examiner*—James G. Smith
*Assistant Examiner*—Derris H. Banks
*Attorney, Agent, or Firm*—Herbert Dubno; Andrew Wilford

[57] ABSTRACT

A crankshaft having a substantially cylindrical crank surface centered on a crank axis and a pair of axially confronting and axially spaced cheek surfaces flanking the crank surface and meeting the crank surface at respective fillets is ground by an apparatus having a shoe between the cheek surfaces and having an end directed at the crank surface and sides directed at and spaced inward from the cheek surfaces. A pair of side parts on the sides of the shoe each can move axially of the shoe relative to the crank axis and a flexible grinding band is stretched over the side parts and shoe. The crankshaft is rotated about the crank axis or an axis parallel thereto and the shoe is urged radially toward the crank axis to press the band against the crank surface. The crankshaft and the shoe between the cheek surfaces are relatively axially reciprocated and each of the side parts is urged axially outward away from the shoe to press the band axially against the cheek surfaces.

10 Claims, 5 Drawing Sheets

FIG.1a
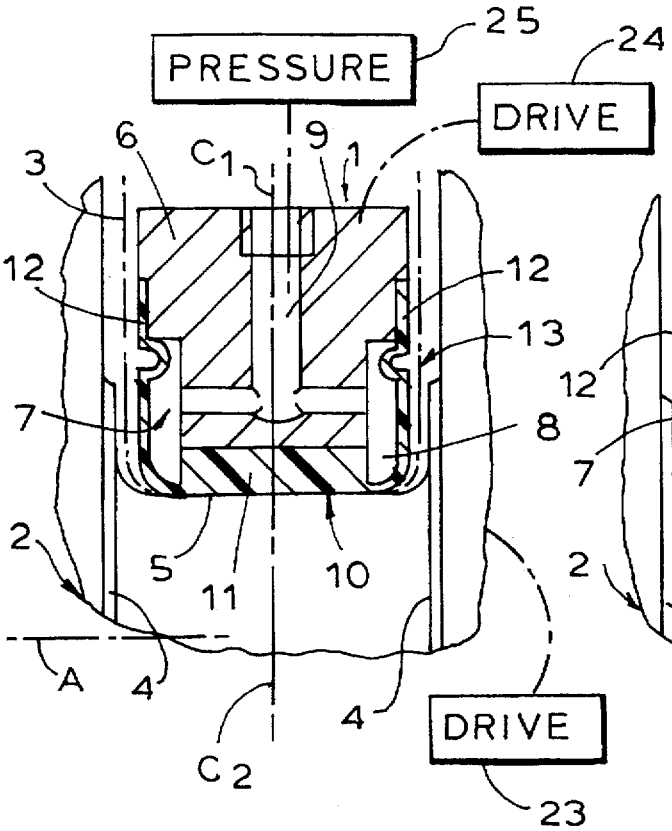
FIG.1b
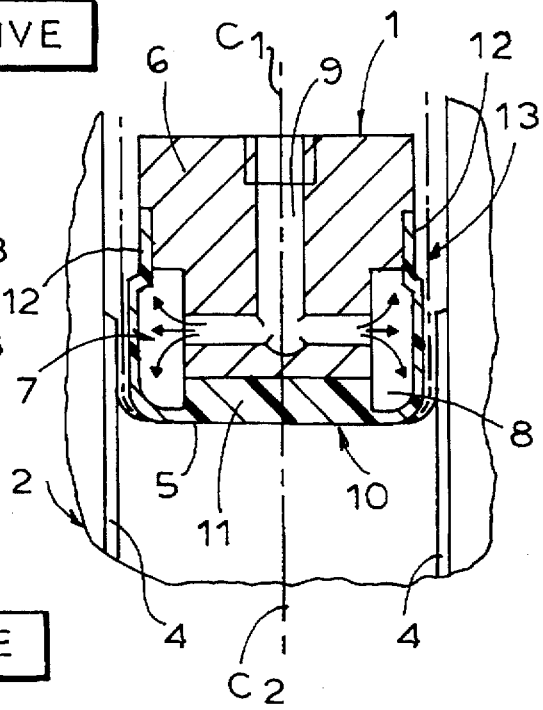
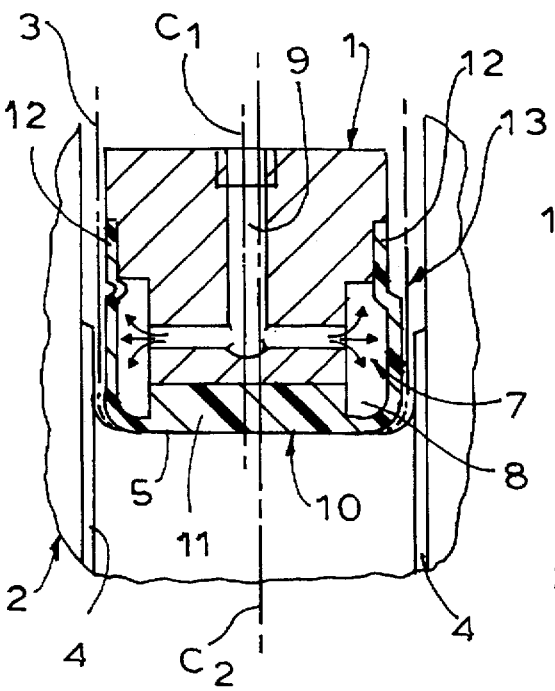
FIG.1c
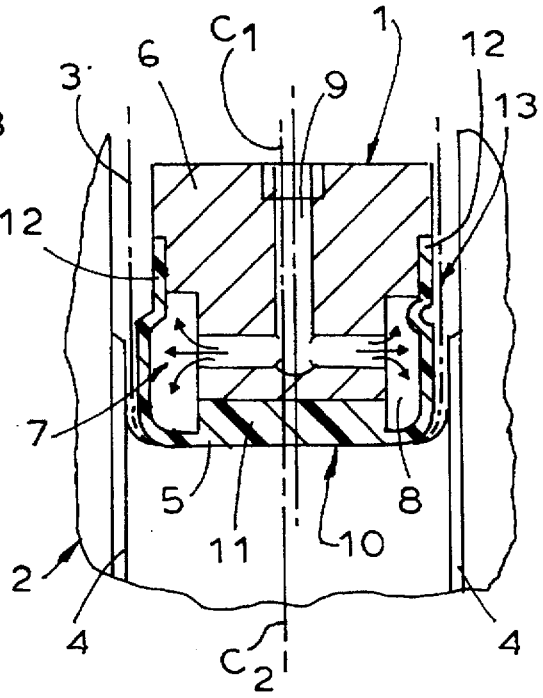
FIG.1d

FIG. 3a
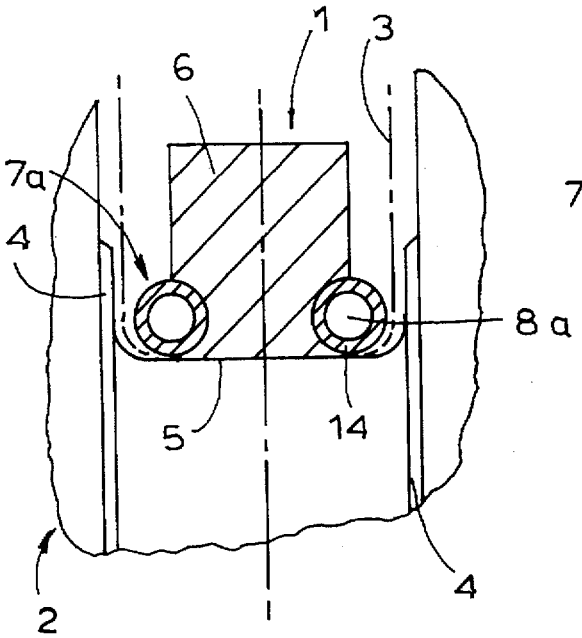
FIG. 3b
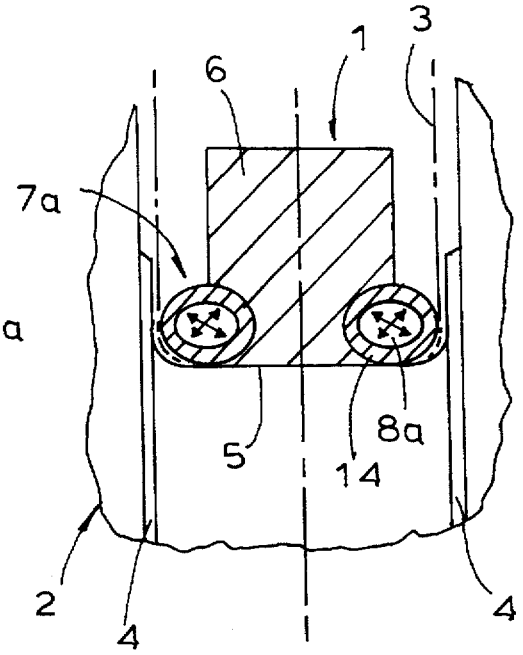
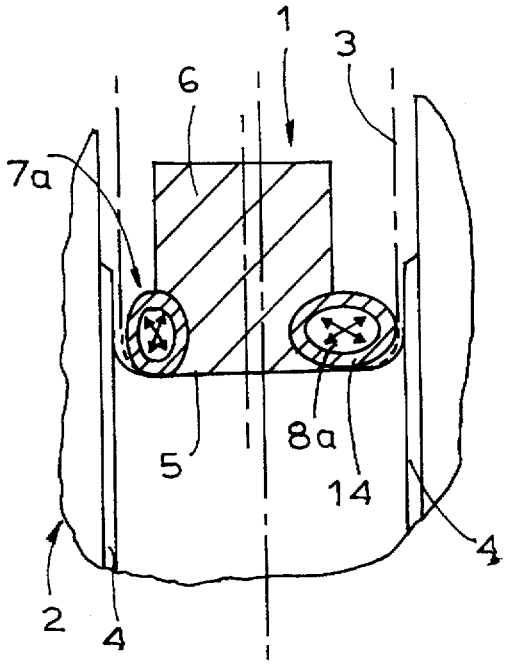
FIG. 3c
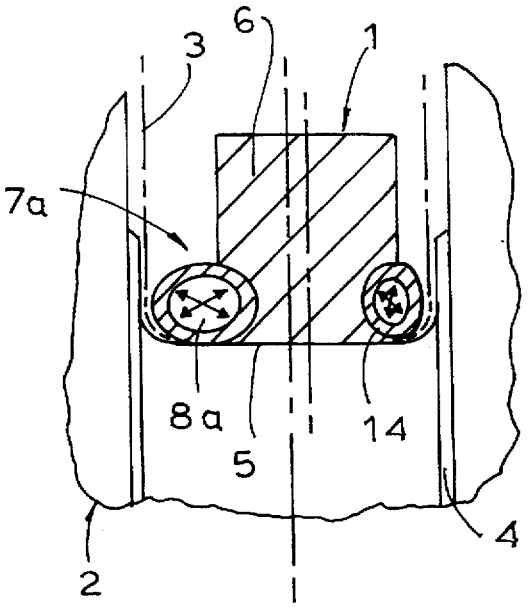
FIG. 3d

FIG. 5
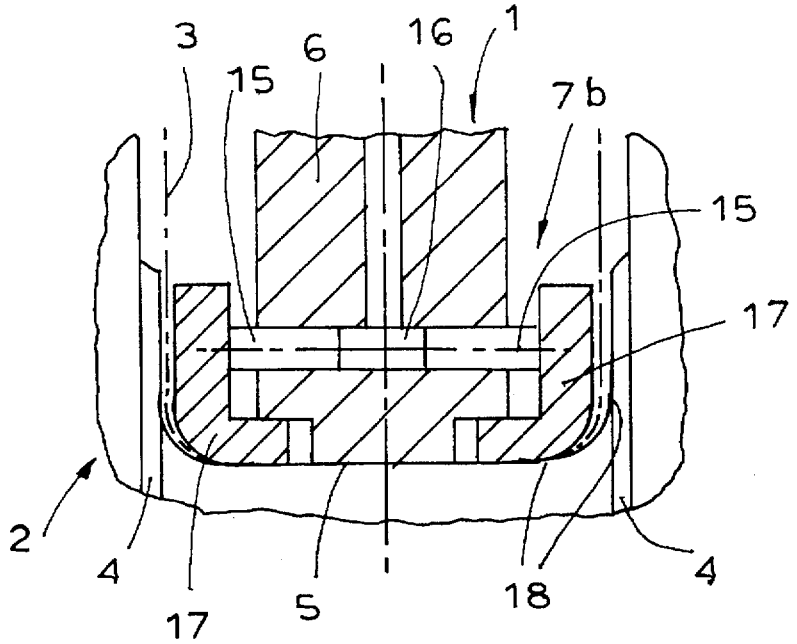
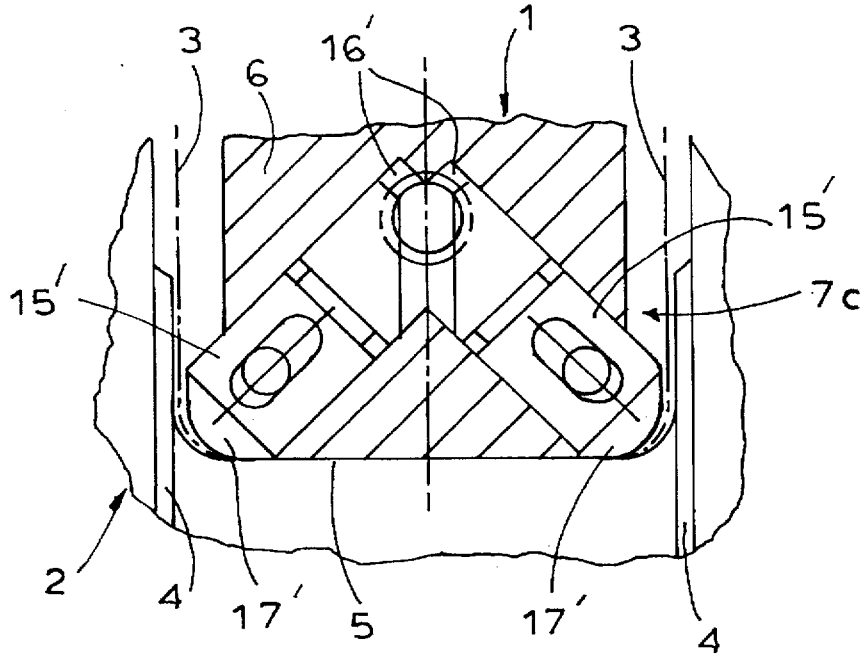
FIG. 6

APPARATUS FOR FINE-GRINDING A CRANKSHAFT

CROSS REFERENCE TO RELATED APPLICATION

This application is related to copending provisional application 60/015629 filed 19 Apr. 1996.

FIELD OF THE INVENTION

The present invention relates to an apparatus for fine-grinding a shaft. More particularly this invention concerns an apparatus for honing the cranks and cheek surfaces of a crankshaft.

BACKGROUND OF THE INVENTION

A crankshaft has a substantially cylindrical crank surface centered on a crank axis and a pair of axially confronting and axially spaced cheek surfaces flanking the crank surface and meeting the crank surface at respective fillets. The crank surface and the cheek surfaces at the fillets must be ground very smooth to very high tolerances for maximum service life of this part which is subject to exceptional stresses.

Such grinding is effected by an apparatus comprising means for rotating the crankshaft about the crank axis, a shoe between the cheek surfaces and having an end directed at the crank surface and sides directed at and spaced inwardly from the cheek surfaces, and a flexible grinding band stretched over the side parts and shoe. The shoe is urged radially toward the crank axis to press the band against the crank surface and it is simultaneously axially reciprocated between the cheek surfaces. Such a device is used to hone the crank surface and fillets, producing a so-called micro- or super-finish since the grinding band does not move on the shoe during the operation.

The shoe is normally a solid block having a fixed axial length. The grinding band is somewhat wider and engages over the sides of the shoe. Thus as the shoe is reciprocated axially, it bumps the one crank surface and then the other. Thus the cheek surfaces and fillets are only in contact with the grinding band for a small fraction of the time that the crank surface contacts the band, during the short times when the shoe is at the end of its axial stroke. As a result these fillets and cheek surfaces are ground very little, and typically annular grinding lines are formed in them. Such lines constitute cracks at which stresses concentrate, and such stresses can lead to premature failure of the crankshaft.

OBJECTS OF THE INVENTION

It is therefore an object of the present invention to provide an improved apparatus for fine grinding a crankshaft.

Another object is the provision of such an improved apparatus for fine grinding a crankshaft which overcomes the above-given disadvantages, that is which uniformly grinds the crank surface, fillets, and even the cheek surfaces without damaging the workpiece.

SUMMARY OF THE INVENTION

A crankshaft having a substantially cylindrical crank surface centered on a crank axis and a pair of axially confronting and axially spaced cheek surfaces flanking the crank surface and meeting the crank surface at respective fillets is ground by an apparatus having according to the invention a shoe between the cheek surfaces and having an end directed at the crank surface and sides directed at and spaced inward from the cheek surfaces. A pair of side parts on the sides of the shoe each can move axially of the shoe relative to the crank axis and a flexible grinding band is stretched over the side parts and shoe. The crankshaft is rotated about the crank axis or an axis parallel thereto and the shoe is urged radially toward the crank axis to press the band against the crank surface. The crankshaft and the shoe between the cheek surfaces are relatively axially reciprocated and each of the side parts is urged axially outward away from the shoe to press the band axially against the cheek surfaces.

The invention is based on the surprising discovery that scratches are completely avoided if the band is held continuously in contact with the workpiece as it is rotated. This is possible according to the instant invention in that the side parts are retracted as the shoe is moved into position on the crankshaft, and are only extended out to press the band against the fillets and cheek surfaces once the end of the shoe is in contact with the crank surface. During the oscillation movement the one side part moves in and the other out and vice versa, keeping the band against the respective surfaces at all times.

According to the invention each of the side parts has a flexible outer wall defining a respective pressurizable compartment and bearing outward on the grinding band. The compartments are pressurized fluid and this fluid can flow between the compartments. The fluid can be a liquid or a gas. Furthermore the shoe includes an element engaged over the end of the shoe and formed integrally with the webs which are formed with folds to allow them to follow the movements of the shoe. Passages are formed in the shoe and extend between the compartments. The element forming the webs can be made of a durable synthetic resin at low cost.

In accordance with another feature of the invention the shoe is provided with a pair of angularly extending tubes forming the compartments and webs. The shoe is formed at its corners with grooves in which these tubes whose ends are closed are set.

In another system according to the invention respective piston/cylinder units in the shoe are braced against the side parts. The side parts are complementary to the crank surface and respective cheek surfaces at the respective fillets. The side parts are arcuate and the units include cylinders extending parallel to the crank axis. Alternately the units include cylinders extending generally at 45° angles to the axis.

The shoe in accordance with the invention has angled surfaces on which the side parts slide and these side parts are complementary to the crank surface and respective cheek surfaces at the respective fillets. In this arrangement respective piston/cylinder units in the shoe bear on the side parts and at least one tension spring is connected to both of the side parts to urge same axially toward each other. Alternately at least one spring is braced radially between the shoe and the side parts.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 1*a* is a partly diagrammatic sectional view illustrating the system of this invention;

FIGS. 1*b* through 1*d* are sectional views like FIG. 1*a* showing the system in different use positions;

FIGS. 3*a* through 3*d* are sectional views illustrating a second system according to the invention in different use positions;

FIG. 5 is a sectional view through a third system of this invention;

FIG. 6 is a sectional view of a variant on the system of FIG. 5;

SPECIFIC DESCRIPTION

Figure 2:
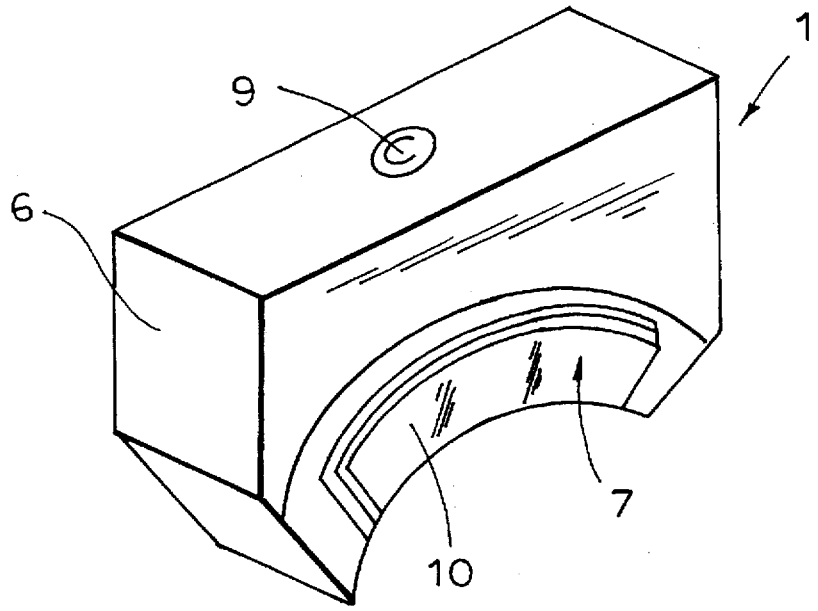
FIG. 2 is a perspective view of the grinding tool of FIGS. 1*a* through 1*d;*
Figure 4:
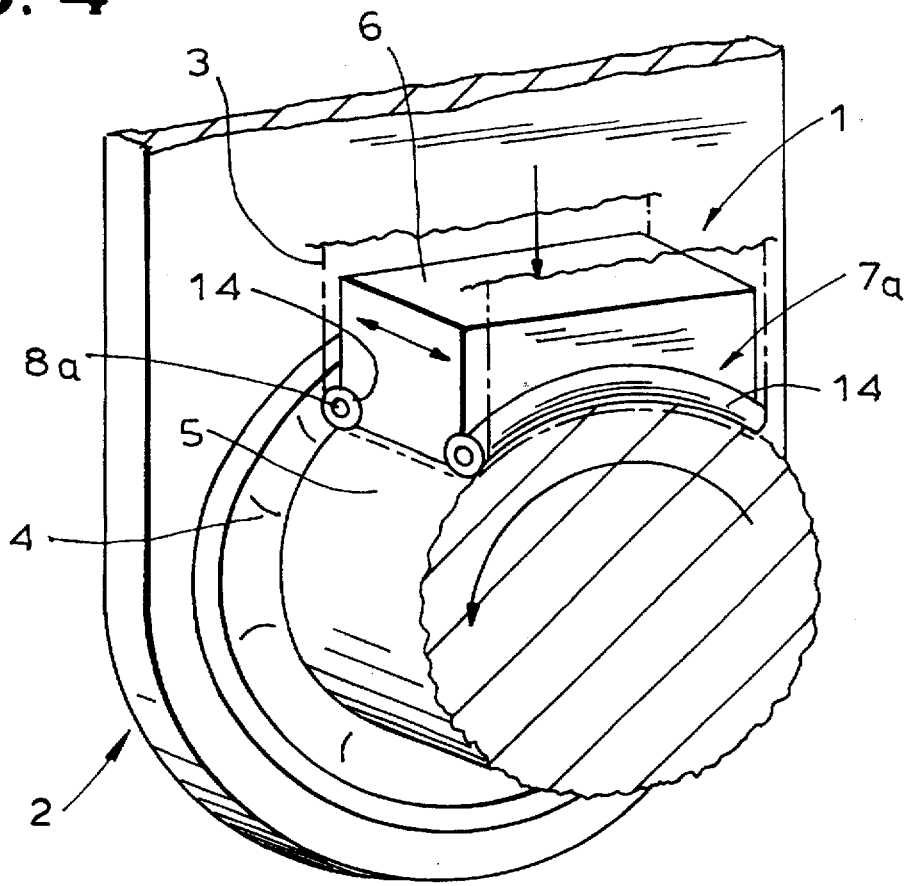
FIG. 4 is a perspective view illustrating the tool of FIG. 3 applied to a crankshaft, partly in section.

As seen in FIG. 1*a* and 2 a crankshaft crank 2 centered on an axis A has a pair of axially confronting cheek surfaces 4 meeting a cylindrical crank surface 5 at rounded inside corners or fillets. A drive indicated schematically at 23 rotates the workpiece 2 about the axis A or about an axis parallel thereto.

A grinding shoe 1 has a body 6 normally of metal and a pair of side parts 7 that can be extended axially. A drive shown schematically at 24 can relatively axially reciprocate the shoe 1 and workpiece 2. To this end the body 6 carries an element 10 of a durable but flexible synthetic resin having an end part 11 that fits complementarily over the crank surface 5 and a pair of elastically deformable side webs 12 each formed with a fold 12 and each sealed against the body 5 to form a compartment 8 that can be pressurized via a passage 9 from a fluid-pressure source indicated schematically at 25. A grinding band 3 is spanned over the shoe 1 and engages between it and the surfaces 4 and 5.

This system is operated as follows:

To start with the compartments 8 are depressurized so that the shoe 1 has an overall axial length somewhat less than the distance between the surfaces 4 and the shoe 1 is engaged against the surface 5. During this radial movement, therefore, the side parts 7 will be out of contact with the surfaces 4 and will not scratch them.

Subsequently the chambers 8 are pressurized as indicated in FIG. 1*b* to press both webs 12 against the inside face of the band 3 to press it in turn against the surfaces 4, and the workpiece 2 is set in rotation.

Then as shown in FIGS. 1*c* and 1*d* the shoe 1 and workpiece 2 are relatively axially reciprocated, moving a centerline C1 of the shoe 1 from one side to the other of a centerline C2 of the surface 2. This causes the fluid to move back and forth through the passages 9 between the chambers 8 as one of the chambers 8 gets bigger and the other smaller and vice versa. At all times the band 3 is held in contact with both of the surfaces 4.

The arrangement of FIGS. 3*a* through 3*d* and 4 differs from that of FIGS. 1*a* through 2 in that chambers 8*a* of side parts 7*a* are created by curved tubes 14 secured to the sides of the shoe body 6. This system works identically to that described above.

In FIG. 5 side parts 7*b* are formed by L-section elements 17 mounted on respective pistons 15 slidable in axially extending bores or cylinders 16 in the shoe body 6. End and bottom surfaces 18 of these elements 17 therefore fit with the surfaces 4 and 5 of the workpiece 2.

A similar arrangement is shown in FIG. 6 but here the elements 17' are directed at 45° angles into the corners between the surfaces and have pistons 15' riding in similarly angled cylinder bores 16'. As described above, as the shoe 1 and workpiece 2 are relatively axially reciprocated the one side part 7*c* moves in while the other moves out and vice versa.

Figure 7A:
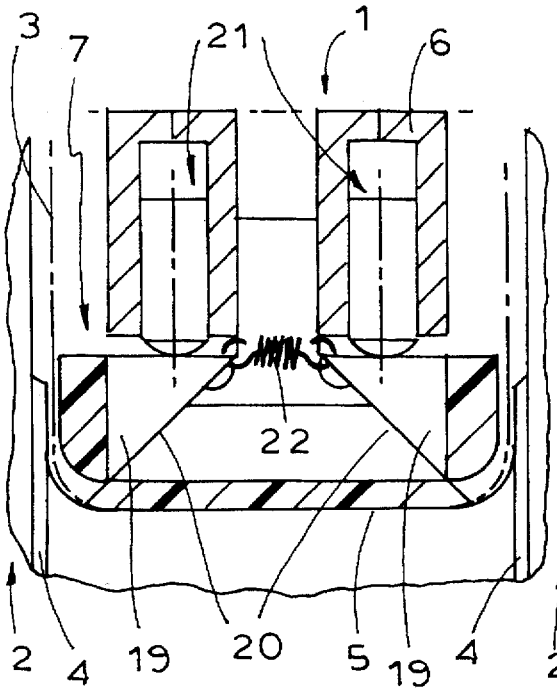
FIGS. 7*a* and 7*b* are sectional vies through a fourth system of the invention.
Figure 7B:
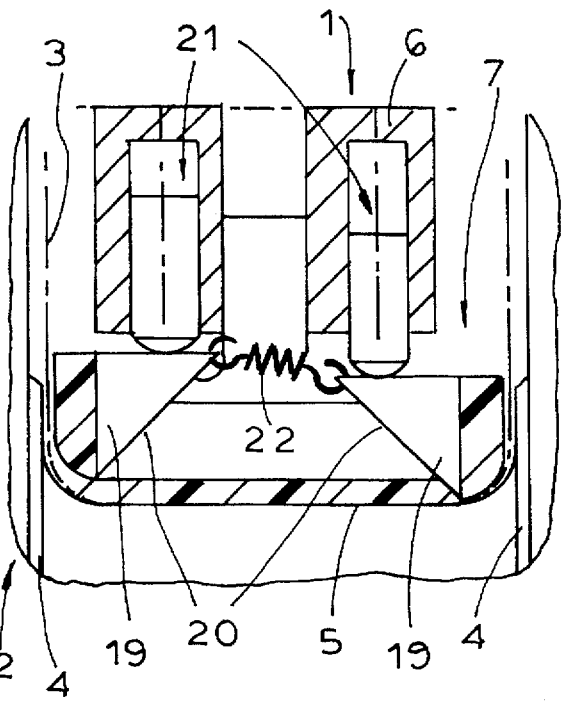

FIGS. 7*a* and 7*b* show an arrangement having side parts 7*b* with elements 19 that ride on angled surfaces 20 of the body 6 so that they can be pressed against surfaces of the workpiece 2. These elements 19 are of a shape complementary to the corner area of the workpiece 2. In order that the elements 19 engage with sufficient pressure on the workpiece 2 the support body 6 is provided with piston/cylinder units 21 that can urge them radially toward the workpiece 2. A spring 22 is hooked between inner ends of the elements 19 to ensure they return to inner starting positions when the units 21 are not pressurized.

Figure 8:
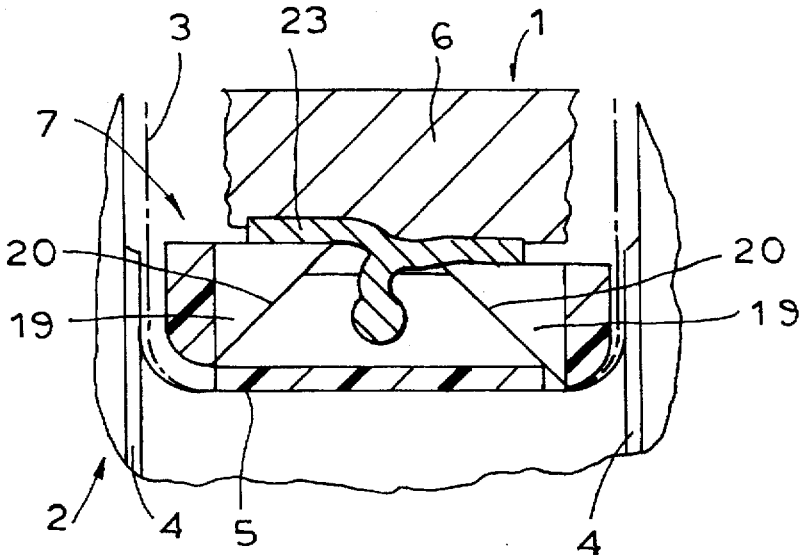
FIG. 8 is a sectional view through a fifth embodiment of the instant invention.

FIG. 8 shows a system like that of FIGS. 7*a* and 7*b*, but here side parts 7*e* formed by elements 19 are merely urged outward by one or more radially stacked springs 23.

We claim:

1. An apparatus for grinding a crankshaft having a substantially cylindrical crank surface centered on a crank axis and a pair of axially confronting and axially spaced cheek surfaces flanking the crank surface and meeting the crank surface at respective fillets, the apparatus comprising:

means for rotating the crankshaft about an axis parallel to the crank axis;

a shoe between the cheek surfaces and having an end directed at the crank surface and sides directed at and spaced inward from the cheek surfaces;

a pair of side parts on the sides of the shoe each movable axially of the shoe relative to the crank axis;

a flexible grinding band stretched over the side parts and shoe;

means urging the shoe radially toward the crank axis for pressing the band against the crank surface;

means for relatively axially reciprocating the crankshaft and the shoe between the cheek surfaces; and means urging each of the side parts axially outward away from the shoe for pressing the band axially against the cheek surfaces.

2. The crankshaft-grinding apparatus defined in claim 1 wherein each of the side parts has a flexible outer wall defining a respective pressurizable compartment and bearing outward on the grinding band, the urging means including means for pressurizing the compartments with fluid and for permitting fluid to flow between the compartments.

3. The crankshaft-grinding apparatus defined in claim 2 wherein the shoe includes an element engaged over the end of the shoe and formed integrally with the webs, the pressurizing means including passages formed in the shoe and extending between the compartments.

4. The crankshaft-grinding apparatus defined in claim 2 wherein the shoe is provided with a pair of angularly extending tubes forming the compartments and webs.

5. The crankshaft-grinding apparatus defined in claim 1 wherein the urging means includes respective piston/cylinder units in the shoe braced against the side parts, the side parts being complementary to the crank surface and respective cheek surfaces at the respective fillets.

6. The crankshaft-grinding apparatus defined in claim 5 wherein the side parts are arcuate and the units include cylinders extending parallel to the crank axis.

7. The crankshaft-grinding apparatus defined in claim 5 wherein the units include cylinders extending generally at 45° angles to the axis.

8. The crankshaft-grinding apparatus defined in claim 1 wherein the shoe has angled surfaces on which the side parts slide, the side parts being complementary to the crank surface and respective cheek surfaces at the respective fillets.

9. The crankshaft-grinding apparatus defined in claim 8 wherein the urging means includes respective piston/cylinder units in the shoe bearing on the side parts and at least one tension spring connected to both of the side parts and urging same axially toward each other.

10. The crankshaft-grinding apparatus defined in claim 8 wherein the urging means includes at least one spring braced radially between the shoe and the side parts.

* * * * *